US005485638A

United States Patent [19]

Newton

[11] Patent Number: 5,485,638

[45] Date of Patent: Jan. 23, 1996

[54] SELF LOCKING FUTON FRAME

[76] Inventor: John H. Newton, 7 Tigertown Rd., White River Jct., Vt. 05001

[21] Appl. No.: 248,884

[22] Filed: May 25, 1994

[51] Int. Cl.[6] ..... A47C 17/17

[52] U.S. Cl. ..... 5/37.1; 5/41; 5/42.1

[58] Field of Search ..... 5/18.1, 37.1, 38, 5/41, 42.1

[56] References Cited

U.S. PATENT DOCUMENTS

| | | | |
|---|---|---|---|
| 3,046,571 | 7/1962 | Ducrot | 5/41 |
| 3,175,861 | 3/1965 | Tcherniavsky | 297/93 |
| 4,205,405 | 6/1980 | Hagney | 5/44 R |
| 4,217,669 | 8/1980 | Fefferman | 5/47 |
| 4,321,716 | 3/1982 | Shrock | 5/18 R |
| 4,543,675 | 10/1985 | Shrock | 5/37.1 |
| 4,642,823 | 2/1987 | Wiggins | 5/47 |
| 4,696,069 | 9/1987 | Crosthwaite | 5/42.1 X |
| 4,996,730 | 3/1991 | Sheffield | 5/37.1 |
| 5,083,333 | 1/1992 | Newton | 5/37.1 |
| 5,103,510 | 4/1992 | Thurow | 5/37.1 |
| 5,153,951 | 10/1992 | Hester | 5/37.1 |
| 5,303,432 | 4/1994 | Fitts | 5/37.1 |
| 5,345,621 | 9/1994 | Newton | 5/37.1 |
| 5,345,626 | 9/1994 | Newton . | |

*Primary Examiner*—Michael F. Trettel
*Attorney, Agent, or Firm*—Michael J. Weins

[57] ABSTRACT

The present invention is for a futon frame which, in combination with a futon, will serve as a sofa or couch when in the closed position and a bed when in the open position. The futon frame has a base having a first end with a first base end slot and a second end with a second base end slot. A back is provided which has a first back side member and a second back side member. A first back pivot pin attaches to the first back side member and a second back pivot pin attaches to the second back side member, with the first back pivot pin slidably engaging the first base end slot while the second back pivot pin slidably engages the second base end slot. Preferably, the base end slots define a serpentine path. A first back support pivotably attaches to the first back side member and the base while a second back support pivotably attaches to the second back side member and the base. A seat having a first seat side member and a second seat side member pivotally attaches to the back. A first seat support pivotably attaches to the first seat side member and to the base while a second seat support pivotably attaches to the second seat side member and to the base. Preferably, the seat is fitted with supplemental support legs which are automatically concealed within the frame during closing. The use of serpentine base end slots reduces the forces one needs to apply in opening and closing the futon frame.

21 Claims, 13 Drawing Sheets

SELF LOCKING FUTON FRAME

FIELD OF INVENTION

The present invention relates to a futon frame and more particularity to a self locking and a self adjusting frame which preferably has self storing supplemental support legs.

BACKGROUND OF THE INVENTION

Convertible couch or sofa frames which use pivoting seat and back supports are taught in U.S. Pat. Nos. 3,046,571; 4,321,716; and 5,103,510. However, these frames are for convertible couches and would not serve well as futon frames. The structure of these frames produces translational motion between the seat and the back which will interfere with the folding and extending of the futon. Furthermore, the linkage is complex and results in a complex multi-component frame.

Frames which do not produce translational motion between the seat and back during opening and closing are taught in U.S. Pat. No. 5,083,333 and co-pending application Ser. No. 08/054,897 of the present inventor. However, these patents teach frames which use locking hardware to directly lock the back to the seat member, stabilizing the back with respect to the seat in the closed position and the open position.

Frames which employ simpler linkages are also taught in U.S. Pat. Nos. 3,175,861; 4,205,405; and 4,217,669. While these patents teach simpler linkages, the resulting frame is not well suited to serve as a frame for a free standing conventional couch or sofa. The '861 patent is a convertible chair which can be placed in various positions but does not open to form a bed. Furthermore, the frame of the '861 patent requires locks to stabilize the chair in its alternate seating positions.

The '405 patent teaches a couch which converts to a bed; however, it teaches a frame that is secured to the surface on which it rests. The frame would also not be well suited for supporting a futon since the couch employs a padded back and seat and requires that a spacing pillow be placed between the back pad and the seat pad. These pads would be inconsistent with using the couch to support a futon. Furthermore, the couch is opened with a pull strap which would not be accessible with a futon in place.

The couch of the '669 patent has a frame which is again designed to be attached to the underlying surface on which it rests and without such attachment, the frame would be unstable, Furthermore, the design of the '669 patent leads to a frame constructed from tubular stock which is not well suited for fabrication from wood and does not provide supplemental support legs.

It should also be pointed out that neither the '405 patent nor the '699 patent teaches, discloses or claims couches which have arms as an integral part of their frames.

Futon frames with supplemental support legs attached to the seat of the futon frame provide additional support when the frame is open providing a sleeping surface. Many of these frames have concealable supplemental support legs which can be swung out of sight by the user when the frame is being closed. Typical patents that teach the use of concealable supplemental support legs which are pivotably attached to the seat of a frame are U.S. Pat. Nos. 4,642,823 and 5,083,333. While these patents teach frames with supplemental support legs attached to the seat of the frame, to position the supplemental support legs with respect to these frames requires that the legs be manually positioned by the user. Self positioning supplemental support legs are taught in U.S. Pat. Nos. 4,996,730 and 5,153,951. However, these legs must have a substantial setback from the front edge of the seat (at least the distance of the floor to seat distance) and thus are less effective in stabilizing the frame when in the open position.

Thus, there is a need for a frame which does not require a locking mechanism between the seat and back member which is suitable for use with a futon. There is also a need for an improved leg configuration for a futon frame which converts to a couch where the leg is both self concealing when stored and will provide a high degree of stability when the frame is opened to form a sleeping surface.

OBJECTS OF THE INVENTION

An object of the present invention is to provide a futon frame for a futon which can be easily opened to form a support surface for a futon serving as a bed and closed to support a futon configured to serve as a chair, sofa, or couch.

Another object of the invention is to provide a futon frame which provides supplemental support legs for the seat of the frame to provide additional stability when the futon frame is in its open position.

It is another object of the invention to provide supplemental support legs for the seat when a futon frame is opened which are self concealing when the futon frame is closed.

It is also an object of the invention to provide adjustment mechanisms which will reduce the force needed to open and close a futon frame.

It is another object of the invention to provide a futon frame which will lock in the open and closed positions and does not require latching hardware.

It is yet another object of the invention to provide a futon frame with a pivotably connected seat and back and which has a sliding action associated with opening and closing the futon frame.

It is another object of the invention to provide means for a futon frame to compensate for warpage, misalignment, or twisting due to irregularities in the surface on which the futon frame is supported.

These and other objects of the invention will be apparent from the following description drawings and claims.

SUMMARY OF THE INVENTION

One simple embodiment of the present invention provides a futon frame which has a base having a first base end with a first base end slot and a second base end with a second base end slot.

A back is provided which is bounded by a first back side member, a top cross member, a second back side member, and a bottom cross member. A seat is pivotably attached to the back. The seat is bounded by a first seat side member, a front cross member, a second seat side member, and a rear cross member. It is preferred that the seat be connected to the back by pivotably engaging the back side members and seat side members.

The back has a first back pivot pin which attaches to the first back side member and a second back pivot pin which attaches to the second back side member. The first back pivot pin slidably engages the first base end slot and the second back pivot pin slidably engages the second base end slot. It is further preferred, that interposed between the back pivot pins and the base end slots are movable bearing surfaces such as sliders or rollers which engage the back pivot pins and reside in the base end slots.

A first back support is pivotably attached to the first back side member and to the base. A second back support is pivotably attached to the second back side member and to the base.

The connection between the back supports and the base are preferably indirect either by having spacers interposed between the back supports and the base ends onto which the spacers are mounted or alternatively, by employing hinges mounted to a base aft cross member which, in turn, is attached to the first base end and the second base end; the back supports can be pivotably mounted thereto A first seat support is pivotably attached to the first seat side member and to the base and preferably to the first base end. A second seat support is pivotably attached to the second seat side member and to the base and preferably to the second base end.

It is further preferred, to facilitate the opening and closing of the futon frame, that the first back support and the second back support pivot about a first pivot axis A which is fixed with respect to the base and about a second pivot axis B fixed with respect to the back.

The first back pivot pin and the second back pivot pin lie on a third axis C which moves in the surface generated by the first base end slot and the second base end slot.

To reduce the relative motion between the futon and the back and seat on which the futon is resting when the frame is opened and closed, it is further preferred that the first back side member and the second back side member pivotably engage the first seat side member and the second seat side member about a fourth axis D fixed with respect to both the back and the seat.

It is also preferred that the first seat support and the second seat support pivot about a fifth pivot axis E which is fixed with respect to the seat and about a sixth axis F which is parallel to the axis E and fixed with respect to the base. Having the pivotal action be about the axes as described above facilitates the cooperative movement among the various elements of the frame and minimizes the motion among the seat, the back and the futon placed thereon.

To further increase the stability of the frame in the open position, it is preferred that a first supplemental support leg be pivotably attached to the first seat side member and a second supplemental support leg be pivotably attached to the second seat side member.

It is still further preferred that the base have a base forward cross member which lies forward of the base aft cross member and that the supplemental support legs have base forward cross member engaging surfaces which slidably engage the base forward cross member when the frame is being opened and closed. The supplemental support legs pivot about pivot points which are forward of the base forward cross member when the seat is in the closed position. The supplemental support legs are positioned such that they will clear the base forward cross member during the initial portion of the closing process and the forward surfaces of the legs will engage the front cross members during the latter stage of the closing process assuring that the legs reside within the base when the futon frame is in its closed position.

Since the weight of the futon is substantial, and since thick futons have limited flexibility, it is further preferred that the ratios of the distances between selected pivot axes be maintained within specified limits to reduce the effort required to open and close the frame and that the relative placement of the pivot axes be so positioned to assure the frame will not open and close accidentally.

Maintaining the axes B, C, D, E, and F co-planar when the futon frame is open serves to lock the futon frame in the open position and will maintain the back and seat in a planar configuration. Any pivoting motion between the back and the seat will be resisted since the seat supports will, under this condition, be axially loaded and thus, not be free to move. In order to move the back relative to the seat, it is necessary to first raise the seat. Similarly, when the futon frame is in a closed position and the axes D, E, and F are co-planar, the back cannot move forward or backward unless the seat is raised since the seat supports are axially loaded.

To facilitate opening, it has been found that when BC and CD are about equal, the back closes easier. It has been also found that lengthening the separation of these axes facilitates closing. However, there is a practical limit of about ten (10) inches to the length CD since longer lengths will excessively lower the seat. Furthermore, it is preferred that AB be greater than BC so that B, C, D, E, and F will be co-planar when the frame is opened. It has also been found that maintaining BD about equal to DE is preferred since as one increases, the length DE, the angle between the seat and the back decreases less as the frame closes. However, if DE becomes too long, the seat becomes too deep for one to comfortably sit since the seat will exceed the hip to knee distance.

To further reduce the effort in opening and closing the futon frame, which becomes particularly difficult when the futon is thick and therefore inflexible, it is preferred that means for altering the kinematics of the seat and back movement be provided. One preferred mechanism for altering the kinematics of opening and closing is to provide a small component of motion of the F axis in the plane defined by the axes E and F. Such can be provided by a slot and spring combination.

Alternatively, it has been found that means for altering the kinematics of opening and closing can be provided by employing a serpentine path for the base end slots to facilitate the opening and closing of the frame. When a serpentine path is employed, it is further preferred that the path over which the rollers track be composed of three segments, a rear segment, a middle segment, and a forward segment. The rear segment is about one forth of the path transversed and has a slight grade gradually rising. The middle segment is about one half of the length of the path, has a shallow grade and gently falls. The front segment again rises and brings the seat into the plane formed by the axes B, E, and F. It is further preferred that the grade of the middle segment be less than about 15°. It is further preferred that the rise of the front section be about twice the rise of the rear section. Having a serpentine path such as described above causes the seat to rise faster on closing assuring the legs move further back before lowering. This further rearward movement assures that the legs will be positioned substantially behind the base forward cross member on closing.

BRIEF DESCRIPTION OF THE FIGURES

As illustrated in FIG. 27, the spring is at its position of minimum strain.

BEST MODE OF CARRYING THE INVENTION INTO PRACTICE

Figure 1:
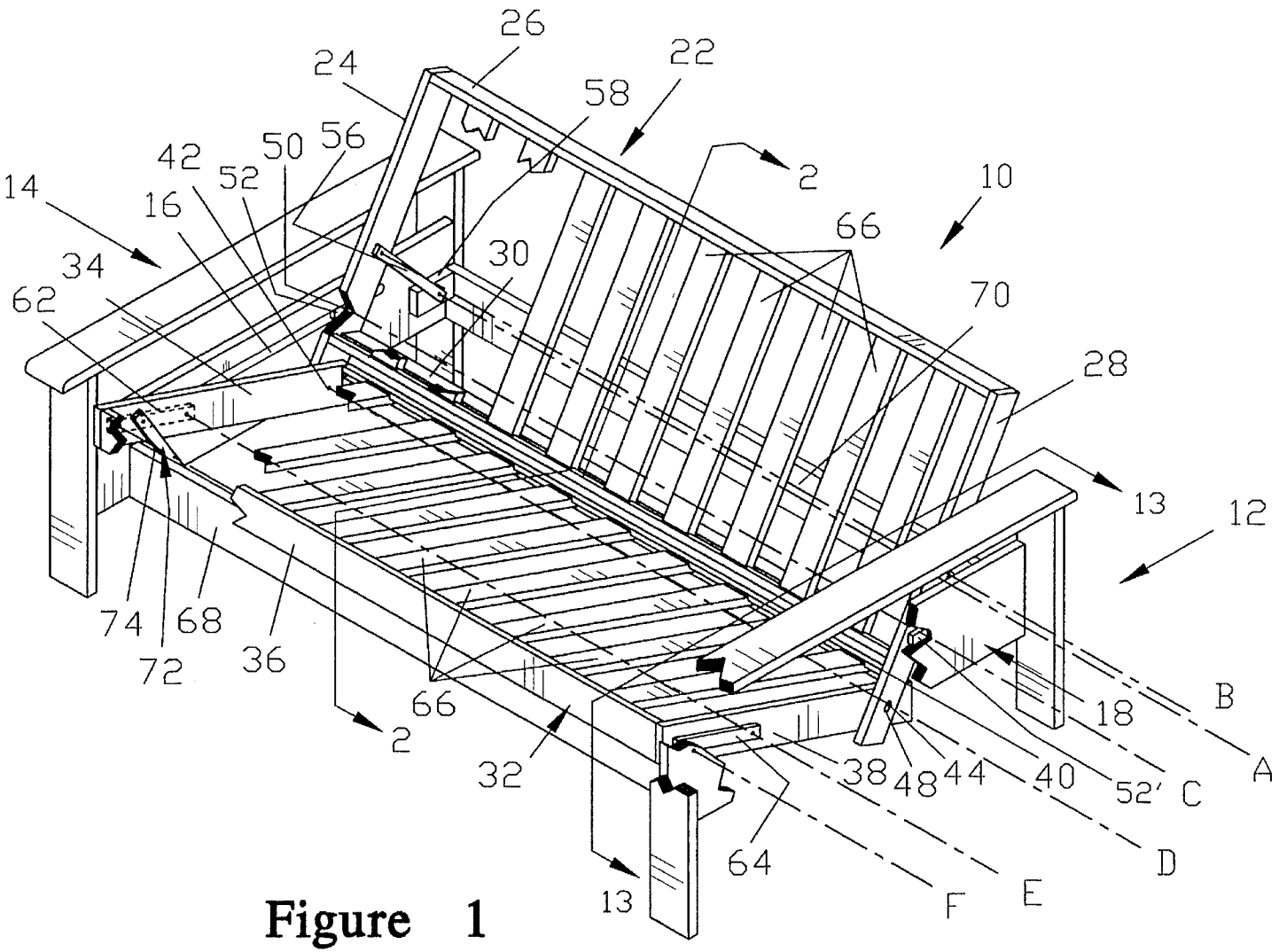
FIG. 1 is an isometric view of one embodiment of the present invention for a futon frame. The futon frame is shown in its closed position where the futon frame, in combination with a futon (not shown) serves as a couch or sofa. The futon frame has a base, a seat, and a back. The futon frame employs a first seat support and a second seat support which are pivotably mounted to the seat and the base. The futon frame also employs a first back support and a second back support which are pivotably attached to the back and to spacers which, in turn, are attached to the base. The seat and back have side members and cross members which form the peripheral elements, bounding the seat and the back. Slats mounted in the cross members provide support surfaces for the futon. The cross members are raised with respect to the slats and serve to limit the slippage between the seat and the back and the futon resting thereon.
Figure 2:
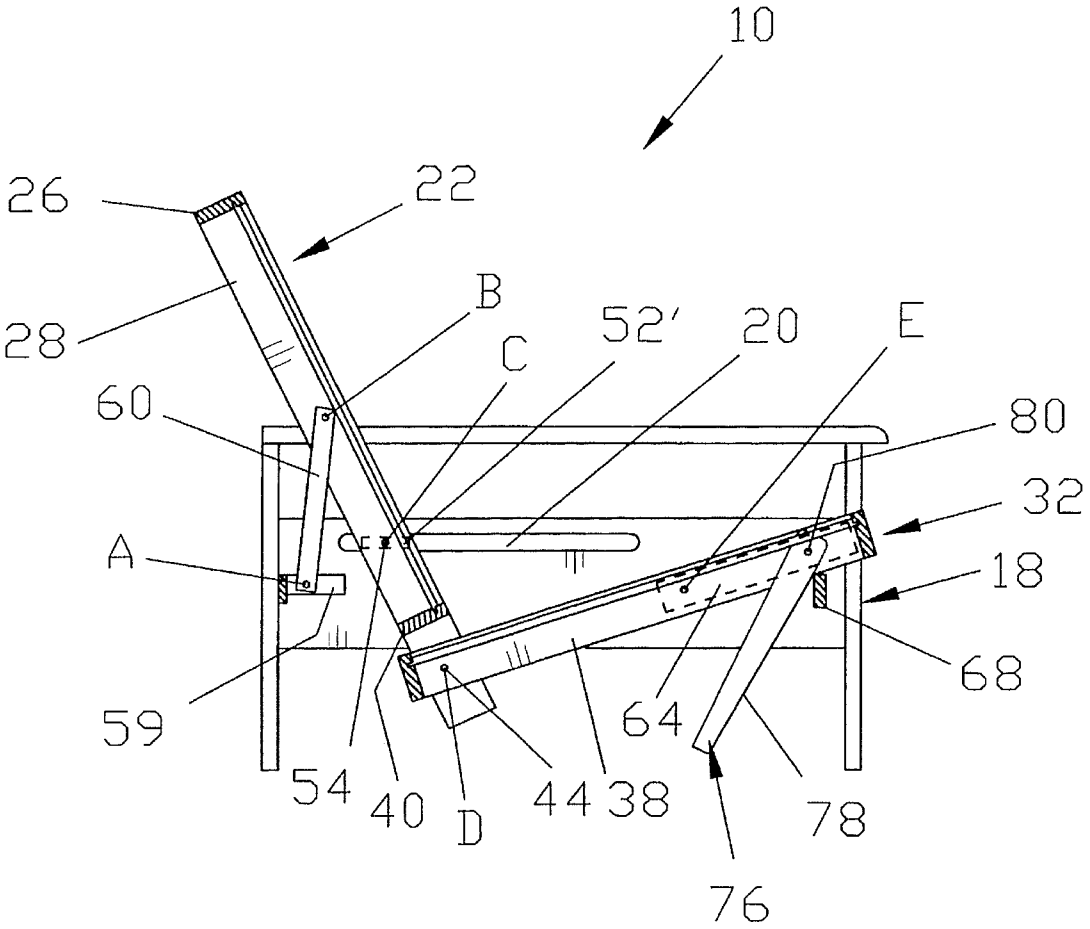
FIG. 2 is a section 2—2 of FIG. 1 illustrating the futon frame in the closed position where the futon frame, in combination with a futon, serves as a couch or sofa.

FIG. 1 is an isometric view of one embodiment of the present invention. A futon frame 10 is illustrated in the closed position. When the futon frame 10 is used in combination with a futon (not shown), it forms a couch or sofa. In the open position, the futon frame 10, in combination with a futon, forms a bed. FIG. 2 is a cross section 2—2 of FIG. 1 and will be used in combination with FIG. 1 to describe the embodiment of FIG. 1.

The futon frame 10 has a base 12 which has a first base end 14 having a first base end slot 16 and a second base end 18 having a second base end slot 20 (shown in FIG. 2). A back 22 is provided which is bounded by a first back side member 24, a top cross member 26, a second back side member 28, and a bottom cross member 30.

A seat 32 is provided which is bounded by a first seat side member 34, a front cross member 36, a second seat side member 38, and a rear cross member 40. The seat 32 is pivotably attached to the back 22. A first seat pivot pin 42 is attached to the first seat side member 34 and a second seat pivot pin 44 is attached to the second seat side member 38. While the present embodiment illustrates the seat pivot pins as being attached to the seat side members, they could equally well be mounted to the back side members.

Figure 11:
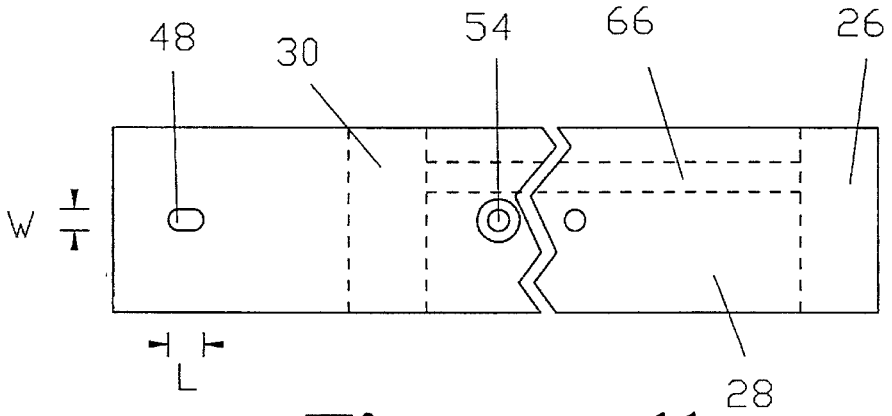
FIG. 11 is a side view of the back side member of FIG. 1.

The first seat pivot pin 42 passes through a first passage 46 (not shown) in the first back side member 24. The second seat pivot pin 44 passes through a second passage 48 in the second back side member 28. It should be appreciated that the seat pins could equally well be attached to the back and pass through passages in the seat 32. These seat pivot pins (42, 44) and corresponding passages (46, 48) serve to pivotably connect the back 22 to the seat 32. FIG. 11 illustrates an enlarged view of the second back side member 28 of the futon frame 10 and illustrates the preferred geometry slots which serve as passages (46, 48) through which the seat pivot pins (42, 44) pass. The preferred geometry for the second passage 48 is a slot which has a width w slightly greater than a diameter d of the second seat pivot pin 44 (not shown) and a length L about twice that of the width. This oblong passage 48 provides flexibility in the connection to accommodate minor adjustments needed for warping and misalignment of the frame elements.

The back 22 has a first back pivot pin 50 attached to the first back side member 24 which pivotably and slidably engages the first base end slot 16. In this embodiment, a slider 52 is interposed between the first back pivot pin 50 and the first base end slot 16. The back 22 has a second back pivot pin 54 (shown in FIG. 2) attached to the second back side member 28 which pivotably and slidably engages the second base end slot 20 (shown in FIG. 2). In this embodiment, a slider 52' is interposed between the second back pivot pin 54 and the second base end slot 20.

Figure 9:
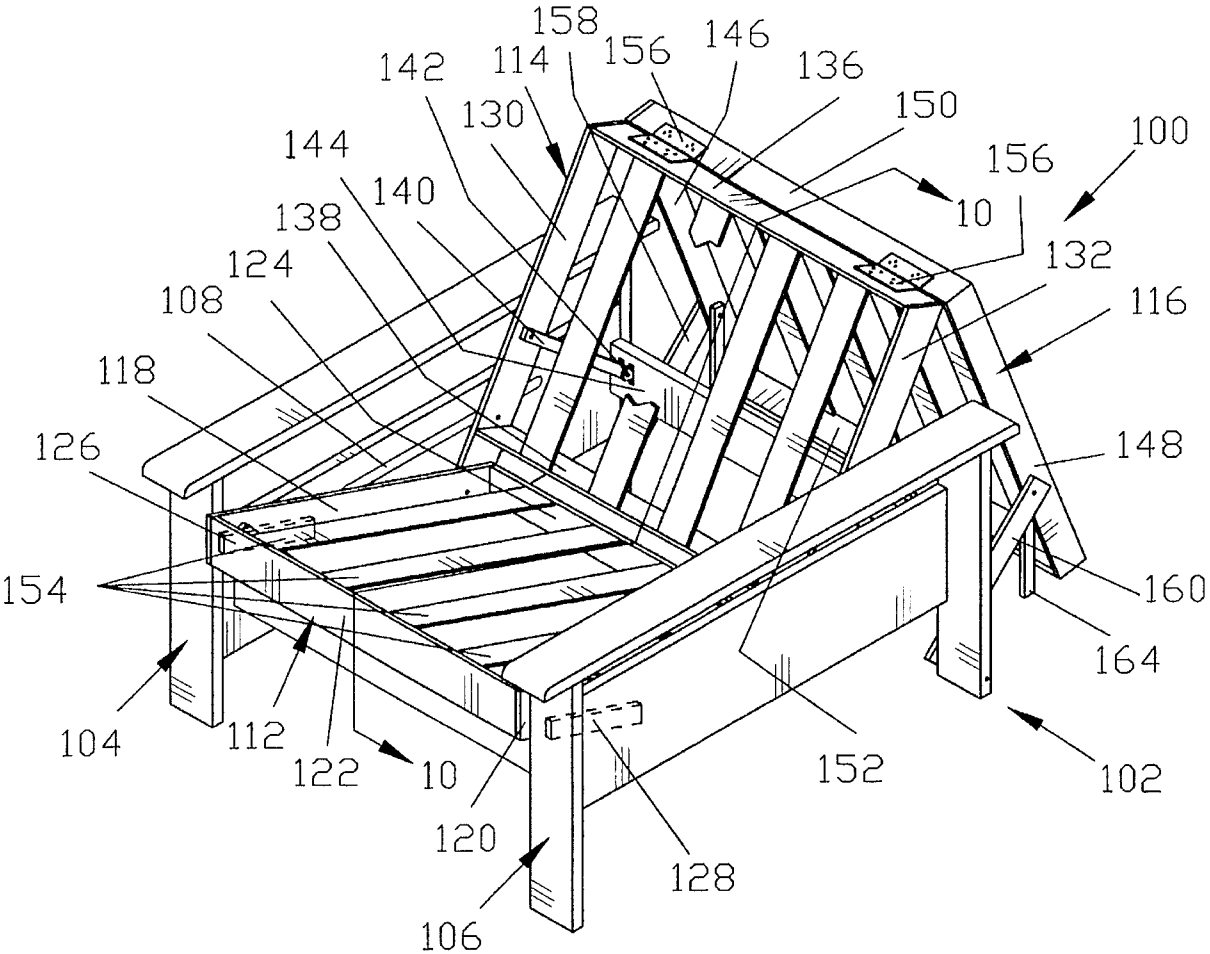
FIG. 9 is an isometric view of another embodiment of the present invention for a futon frame which, when used in combination with a futon, provides a chair in the closed position (shown) and a bed when in the open position.
Figure 10:
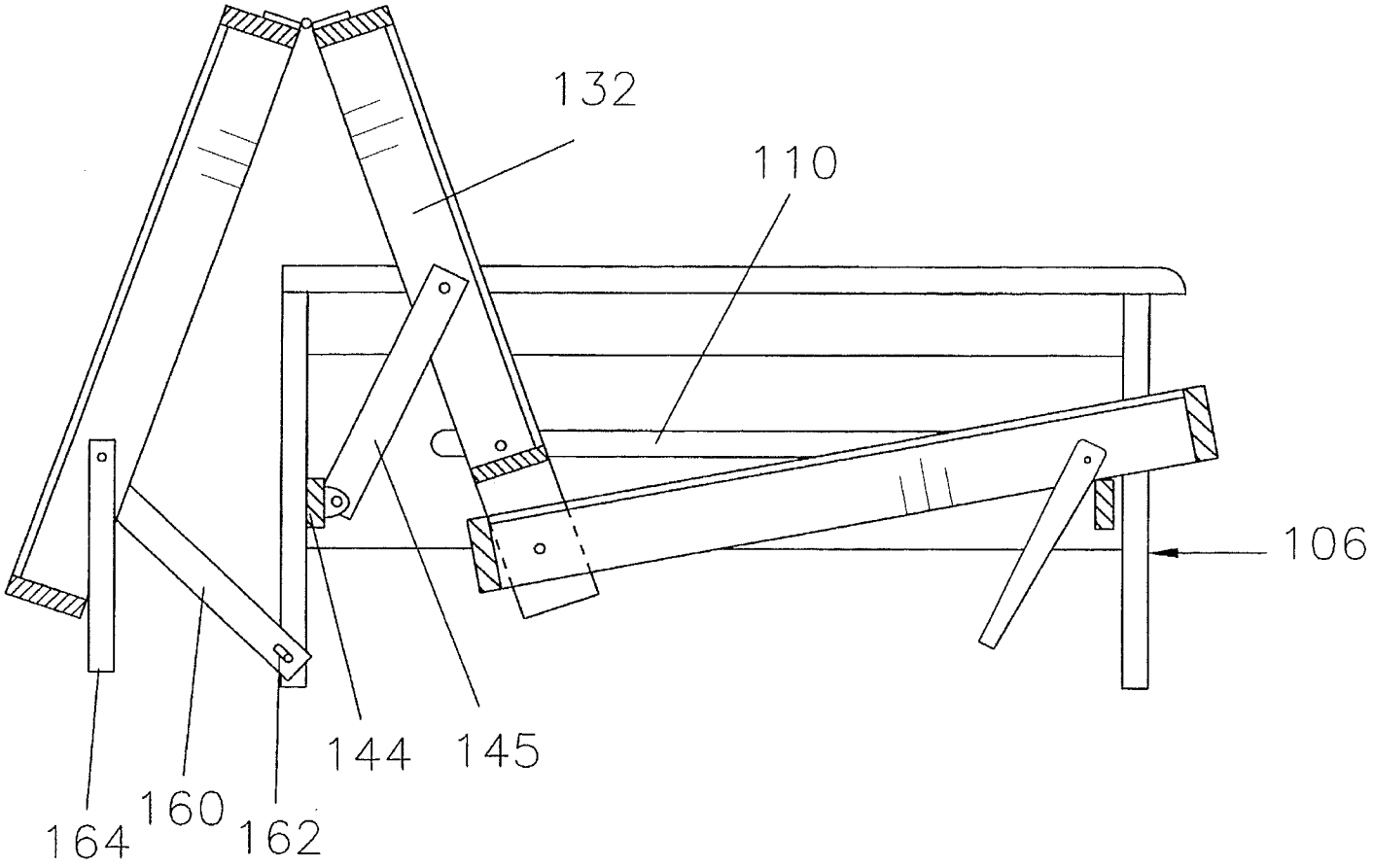
FIG. 10 is a cross section 10—10 of FIG. 9 and illustrates the use of a slot to provide adjustment resulting from misalignment of the elements.

A first back support 56 pivotably attaches to the first back side member 24 and to the base 12. In this embodiment, the pivotable attachment to the base 12 is to the first base end 14 which is fitted with a first spacer 58. Similarly, a second back support 60 (best illustrated in FIG. 2) pivotably attaches to the second back side member 28 and to the base end 18. Again, the connection is to the second base end 18 and a second spacer 59 is interposed between the second back support 60 and the second base end 18. An alternate attachment of the back supports to the futon frame 10 is illustrated in FIGS. 9 and 10 and will be discussed later.

A first seat support 62 (hidden in FIG. 1 by the first seat side member 34) pivotably attaches to the first seat side member 34 and to the first base end 14 of the base 12. A second seat support 64 pivotably attaches to the second seat side member 38 and to the second base end 18 of the base 12.

Slats 66 are provided for the seat 32 and the back 22 which serve to support the futon. The slats 66 for the back 22 attach the top cross member 26 of the back 22 and the bottom cross member 30 of the back 22. To enhance the gripping of the futon by the futon frame 10, it is preferred that the top cross member 26 and the bottom cross member 30 be raised with respect to the slats 66. Similarly, the slats 66 for the seat 32 attach to the front cross member 36 and the rear cross member 40 of the seat 32. Again, for the reason discussed above, it is preferred that the front cross member 36 and the rear cross member 40 be raised with respect to the slats 66.

The base 12 has a base forward cross member 68 and a base aft cross member 70, both of which connect to the first base end 14 and the second base end 18 and serve to further stabilize the base 12. The base forward cross member 68 also provides partial support for the seat 32 when the futon frame 10 is in its open position and its closed position. Similarly, the aft cross member 70 provides partial support to the back 22 when the futon frame 10 is in its open position.

To stabilize the futon frame 10 when it is in the open position, supplemental support legs (72, 76) are provided. The first supplemental support leg 72, having a first base forward cross member engaging surface 74, is pivotably attached to the first seat side member 34 forward of the base forward cross member 68 and in close proximity to the front cross member 36 of the seat 32 as is illustrated in FIG. 1. The second supplemental support leg 76 (shown in FIG. 2), having a second base forward cross member engaging surface 78, is pivotably attached to the second seat side member 38. Since the supplemental support legs pivot toward the base aft cross member 70 on closing, pivot points 80 for the supplemental support legs (72, 76) should be placed so as to remain forward of the base forward cross member 68 during the latter stages of closing and in close proximity to the front cross member 36 of the seat 32. Such is not possible for the pivotable support legs of the '730 and '951 patents. The supplemental support legs (72, 76) are positioned such that the first and second base forward cross member engaging surfaces (74, 78) engage the base forward cross member 68 and direct the first supplemental support leg 72 and the second supplemental support leg 76 to a position concealed by and stored behind the base forward cross member 68 of the futon frame 10, as shown in FIG. 1.

Figure 3:
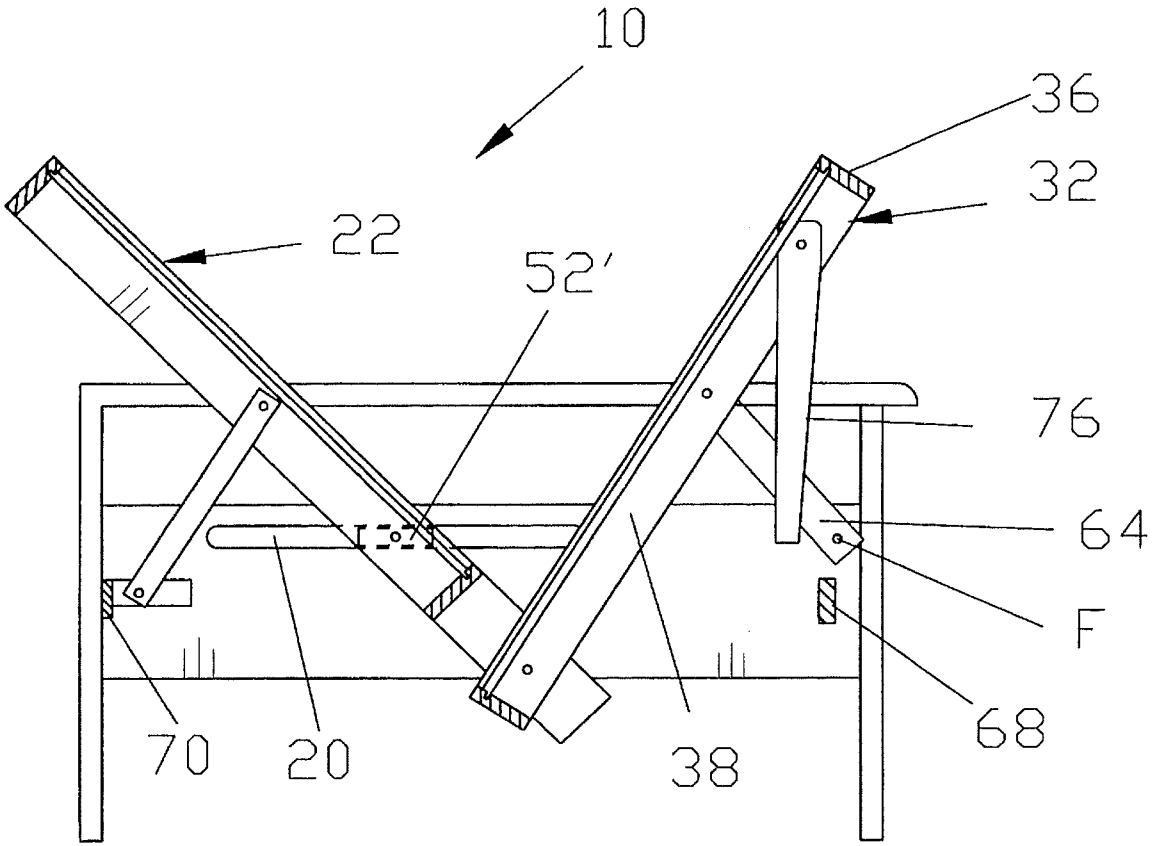
FIG. 3 is an illustration of the cross section of FIG. 2 in an intermediate position between the closed position and the open position.
Figure 4:
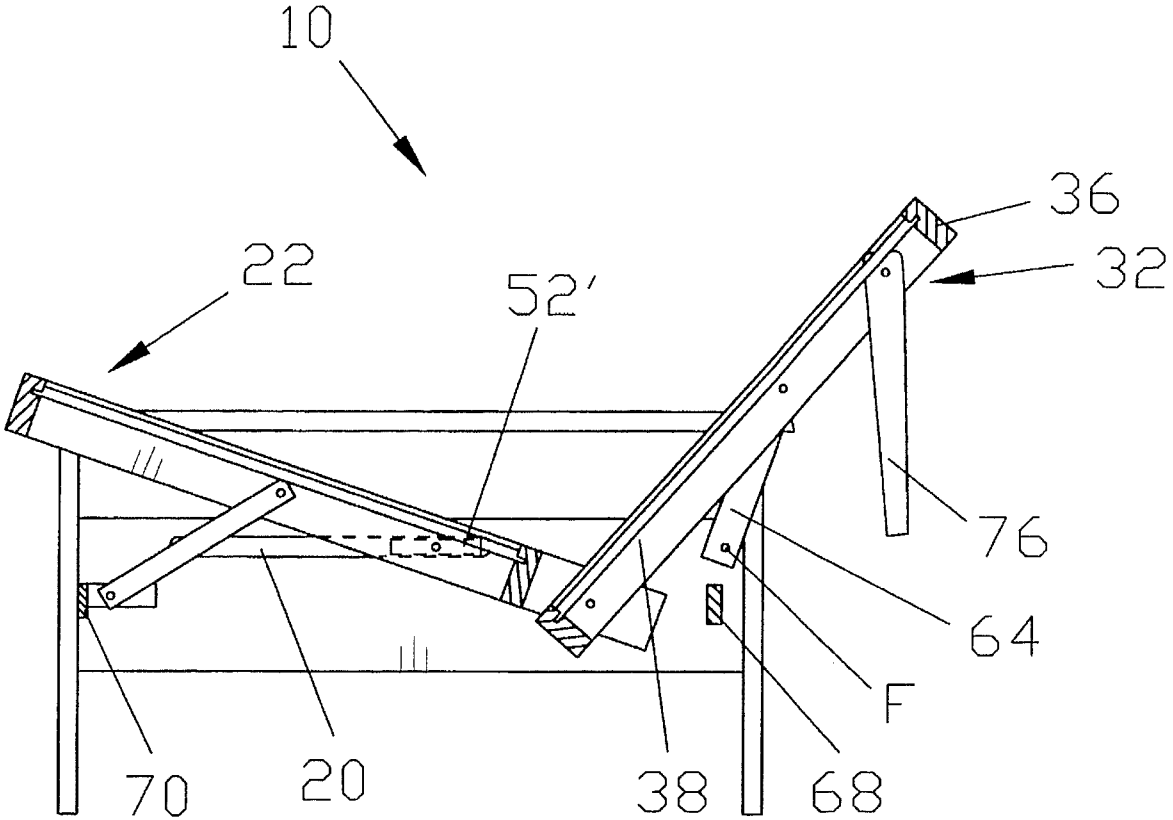
FIG. 4 is an illustration of the cross section of FIGS. 2 and 3 wherein the frame is partially open and has moved further toward the open position.

FIG. 3 illustrates the futon frame 10 where the front cross member 36 of the seat 32 has been raised and the seat 32 has moved forward to a position where it would be at an early stage of the opening of the futon frame 10. In the position illustrated in FIG. 3, the supplemental support legs (72, 76) have passed over the base forward cross member 68 and will lower in front of the base forward cross member 68 as the futon frame 10 is opened. FIG. 4 illustrates the futon frame 10 as the seat 32 is in a further stage of the opening process.

Figure 5:
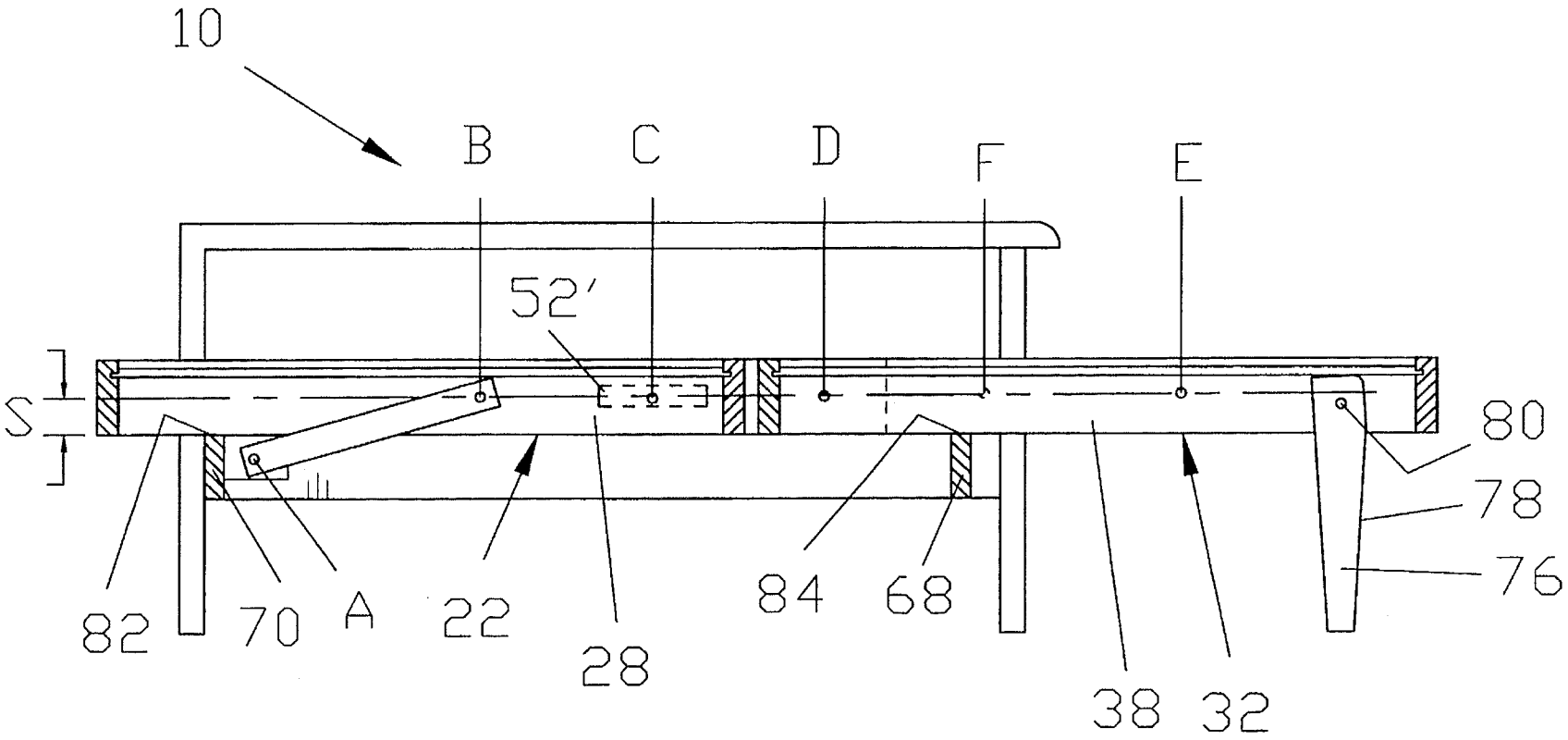
FIG. 5 is an illustration of the cross section of FIGS. 2 through 4 where the futon frame is in the open position. In the open position, the futon frame, in combination with a futon, will serve as a bed.

FIG. 5 illustrates the futon frame 10 in the open position where the back 22 and the seat 32 are co-planar and serve as a surface on which an extended futon will rest and, in combination with the futon frame 10, form a bed. In this position the supplemental support legs (72, 76) provide additional support to avoid tipping of the futon frame 10 when weight is applied to the forward portion of the seat 32.

As can be seen from reviewing FIGS. 2 through 5, the futon frame 10 moves from a closed position where, with a futon resting thereon, the futon frame 10 will serve as a couch or sofa to an open position where, with a futon resting thereon, the futon frame 10 will serve as a bed. This motion is obtained with minimal translational motion between the seat 32 and back 22 with respect to a futon resting thereon since the seat 32 and the back 22 are pivotably attached.

Referring principally to FIG. 2 in combination with FIG. 1, during opening and closing of the futon frame 10, the first back support 56 and the second back support 60 pivot about a first axis A which is fixed with respect to the base 12 and simultaneously pivot about a second parallel pivot axis B which is fixed with respect to the back 22.

The back pivot pins (50, 54) lie on a third common axis C and this axis is parallel to the axes A and B (as shown in FIG. 1) and moves across the plane defined by the first base end slot 16 and the second base end slot 20, illustrated with the second base end slot 20 shown in FIG. 2. Having the third axis C so defined and maintaining the parallel relationship between the axes A and B assures that the motion of these axes will provide cooperative movement between the elements so connected.

A fourth axis D, which is fixed with respect to both the seat 32 and the back 22, further promotes the cooperative action between the various connected elements and assures that only rotational motion will occur between the seat 32 and the back 22. The seat pivot pins (42, 44) lie on the fourth common axis D, which is parallel to the axes B and C.

The first seat support 62 and the second seat support 64 pivot about a fifth pivot axis E which is fixed with respect to the seat 32 and a sixth axis F (shown in FIGS. 3 and 4) which is fixed with respect to the base 12. Again, the fifth axis E and the sixth axis F are parallel to the axes A, B, C and D.

The axes B, C, D, E and F are also so positioned that, when the futon frame 10 is open and the back 22 is in contact with the base aft cross member 70 and the seat 32 is in contact with the base forward cross member 68, the axes B, C, D, E and F are co-planar as is illustrated in FIG. 5. The base aft cross member 70 has a contact surface 82 and the base forward cross member 68 has a contact surface 84. To maintain co-planar alignment of the axes, it is necessary for the contact surfaces (82, 84) of the base aft cross member 70 and the base forward cross member 68 to be planar and the separation from that plane to the plane of the co-planar axes B, C, D, E and F must be the distance S.

The kinematics of opening and closing as described above operate most favorably when BC and CD are about equal since the back closes easier. (See FIGS. 2 and 5.) It has been also found that lengthening the separation of these axes facilitates closing. However, there is a practical limit of about ten (10) inches to the length of CD, since longer lengths will excessively lower the seat. Furthermore, it is preferred that AB be greater than BC so that B,C,D,E, and F will be co-planar when the futon frame 10 is opened. It has also been found that maintaining BD about equal to DE is preferred since as one increases the length DE, the angle between the seat 32 and the back 22 decreases less as the futon frame 10 closes. However, if DE becomes too long, the seat 32 becomes too deep for one to comfortably sit, since the seat 32 will exceed the hip to knee distance.

Figure 6:
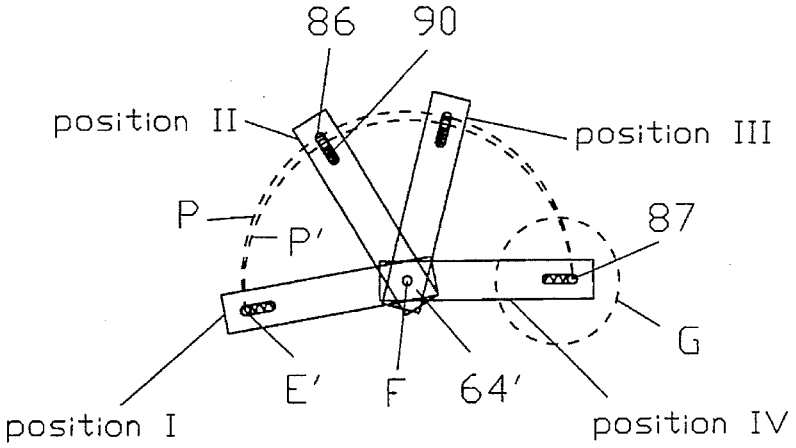
FIG. 6 is a schematic representation of a seat support which provides means for altering the kinematics of opening and closing a futon frame. The seat support is shown in multiple positions including the positions it assumes when the frame is closed and when it is open.

In situations where the futon is either very heavy or its thickness is such that the futon is stiff and difficult to fold, it is further preferred that other means for altering the kinematics of opening and closing be provided. FIG. 6 illustrates a modified seat support configuration 64' which can be substituted for the seat supports (62, 64) and used in combination with the futon frame 10 shown in FIG. 1. The seat support 64' reduces the force needed to open and close the futon frame 10. FIG. 6 illustrates the seat support 64' in four positions. The first position I is associated with the closed position of the futon frame 10 shown in FIG. 2. The second position II is associated with the partially open position shown in FIG. 3. The third position III is the position associated with the partially open position of FIG. 4 and the fourth position IV is the position associated with the fully opened futon frame 10 of FIG. 5. The seat support 64' pivots about the axis F of the futon frame 10. However, in this embodiment, rather than pivoting about the axis E at a fixed distance with respect to the axis F, the seat 32 pivots about an axis E' with respect to the axis F, providing a translational motion. A slot 86 is provided in the seat support 64' through which a seat support pivot pin 87 passes. The slot 86 changes the traverse of the axis E from a circular path P to a lower path P', reducing the work associated with raising the seat 32 thus, making the futon frame 10 easier to open and close.

Figure 7:
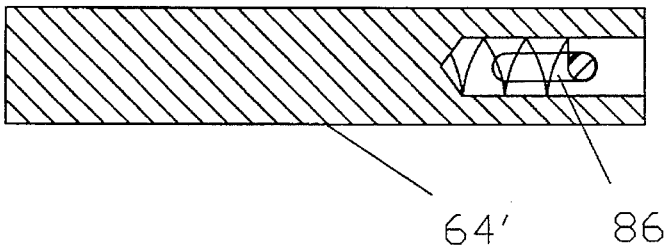
FIG. 7 is an enlarged elevation view of the encircled region of FIG. 6.
Figure 8:
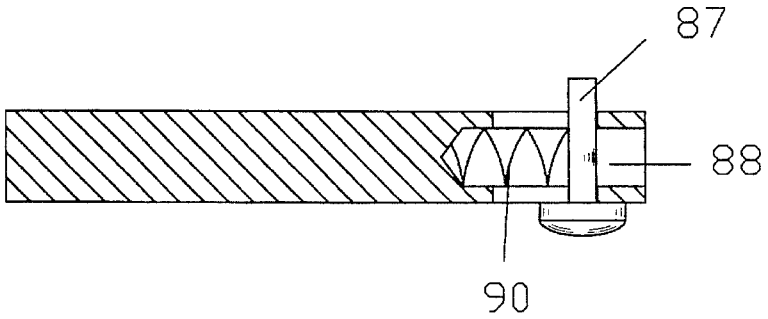
FIG. 8 is an enlarged top view of the encircled region of FIG. 6.

FIGS. 7 and 8 are, respectively, a top view and an elevation view of region G of FIG. 6, further illustrating the slot 86 of the seat support 64'. A cylindrical hole 88 is provided in the seat support 64' which parallels the slot 86 for holding a spring 90. The spring 90 biases the seat support pivot pin 87 which serves as the rotational axis of the seat support 64' with respect to the seat 32. The spring 90 allows the seat 32 to translate relative to the seat support 64'.

FIG. 9 is another embodiment of the present invention. This embodiment is for a futon frame 100 which forms a tri-fold futon frame which, in combination with a futon, converts from a chair, as shown in FIG. 9, to a bed. The futon frame 100 has a base 102 which has a first base end 104 and a second base end 106. The first base end 104 has a first base end slot 108 and the second base end 106 has a second base end slot 110 as shown in FIG. 10. A seat 112 is pivotably connected to a back 114 which in turn is pivotably connected to a rear deck 116.

The seat 112 has a first seat side member 118 and a second seat side member 120. These seat side members (118, 120), in combination with a front cross member 122 and a rear cross member 124, form the periphery of the seat 112. A first seat support 126 shown behind the first seat side member 118, pivotably attaches to the first seat side member 118 and the first base end 104. A second seat support 128 pivotably attaches to the second seat side member 120 and the second base end 106.

The back 114 has a first back side member 130 and a second back side member 132. A back top cross member 136 and a back bottom cross member 138 complete the periphery of the back 114. A first back support 140 is pivotably attached to the base 102 and the first back side member 130. The attachment to the base 102 is by a hinge 142 which in turn is connected to a base aft cross member 144. A second back support 145 (shown in FIG. 10) is provided which is pivotably attached to the base 102 and to the second back side member 132 in an analogous manner as the first back support 140.

The rear deck 116 has a first rear deck side member 146 and a second rear deck side member 148 which, in combination with a back cross member 150 and a free end cross member 152, form the periphery of the rear deck 116.

The seat 112, the back 114, and the rear deck 116 have slats 154 which connect the cross members of the seat 112, the back 114, and the rear deck 116 forming a support surface on which a futon rests. These slats 154 are so positioned to provide a planar surface and, in combination with the side members and the cross members, form a planar seat, back, and rear deck surfaces on which the futon rests.

The rear deck 116 is pivotably connected to the back 114 with hinges 156 which attach to the top cross member 136 of the back 114 and the back cross member 150 of the rear deck 116. A first rear deck support 158 pivotably attaches to the base 102 and to the first rear deck side member 146. A second rear deck support 160 pivotably attaches to the second rear deck side member 148 and to the base 102.

When direct connection is made between the rear deck 116 and the base 102 with single element rear deck supports (158, 160), it is preferred that adjustment slots 162 (shown in FIG. 10) be provided in the rear deck supports (158, 160) and that these slots 162 are spring loaded and similar in character to the slots shown in FIGS. 7 and 8. These slots 162 allow accommodation to be made for misalignment between the members which may result from a variety of causes including having the futon frame 100 resting on an irregular surface.

Pivoting deck legs 164 are attached to the rear deck 116 which provide additional stability to the futon frame 100 when the frame 100 is open to form a bed. If the deck legs 164 are to be self storing and mounted on the rear deck side supports (158, 160), then the deck legs 164 must attach at a point which will remain at or above the height which is greater than the distance between the rear deck side member 146 and the ground when the futon frame 100 is in the open position.

Figure 12:
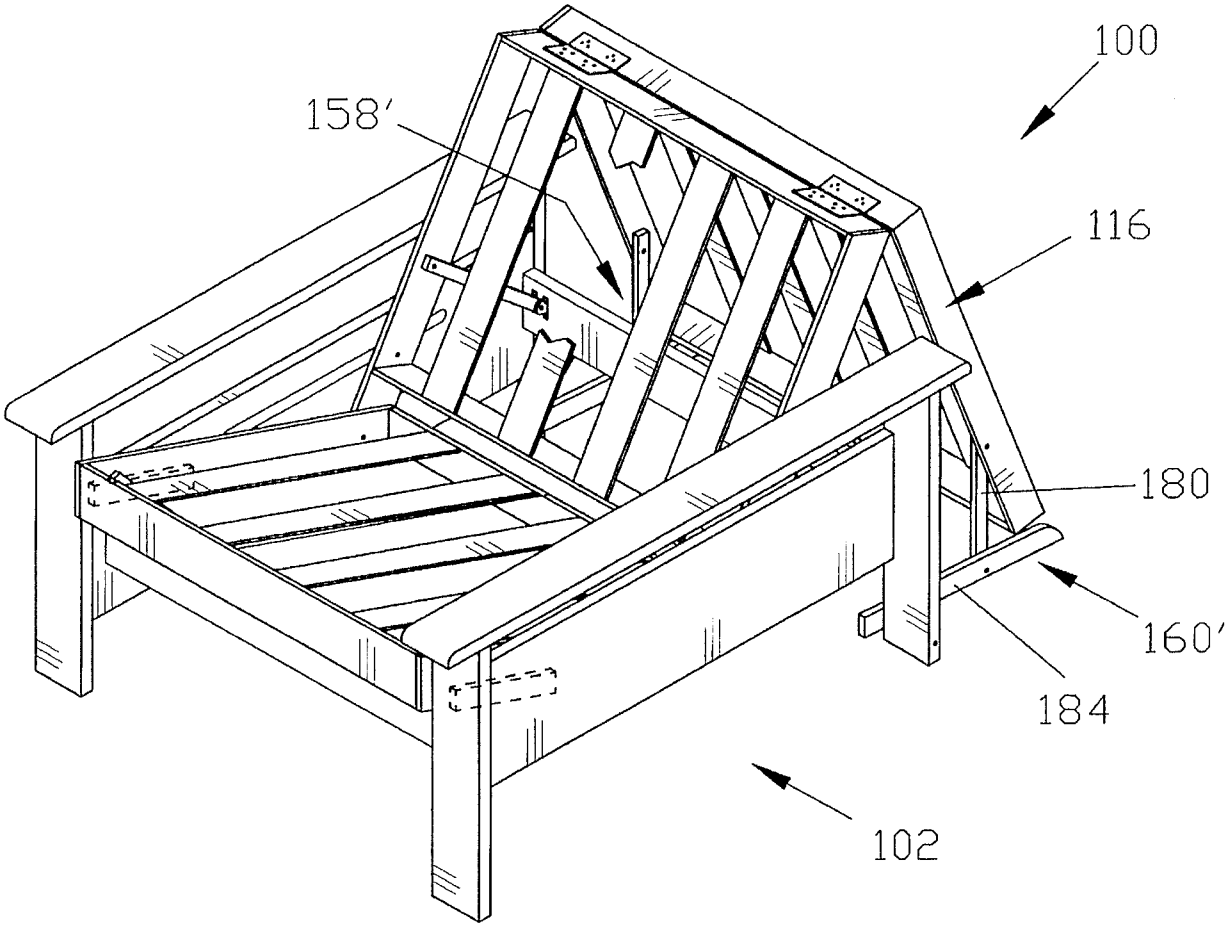
FIG. 12 is an isometric view of a futon frame similar to the futon frame of FIG. 9. Two-part rear deck supports are employed to accommodate misalignment between frame elements which could effect the opening of the frame.
Figure 15:
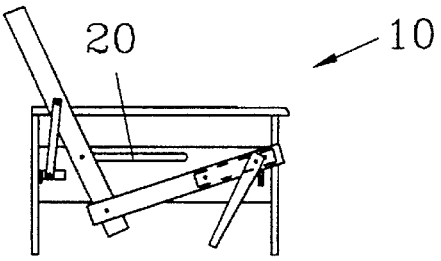
FIGS. 15 through 20 are side views of the frame of FIG. 1 where substantially horizontal base end slots are employed in various stages of opening.

While the use of slots in the rear deck supports (158, 160) can provide for adjustment of the rear deck supports (158, 160) as shown in FIG. 9, the adjustability can be provided by employing two-part rear deck supports (158', 160') such as shown in FIG. 12 This provides for adjustability by providing a first segment 180 which attaches to the rear deck 116 and a second segment 184 which attaches to the base 102. The first segment 180 is pivotably connected the second segment 184.

Similarly, by using segmented seat links, it is possible to provide means for altering the kinematics of the seat and back movement and to reduce the force needed to open and close the futon frame. However, this solution has its limitations in that by so doing one reduces the stabilizing action in the open position since there is less stability against compressive loads of the seat supports.

Figure 13:
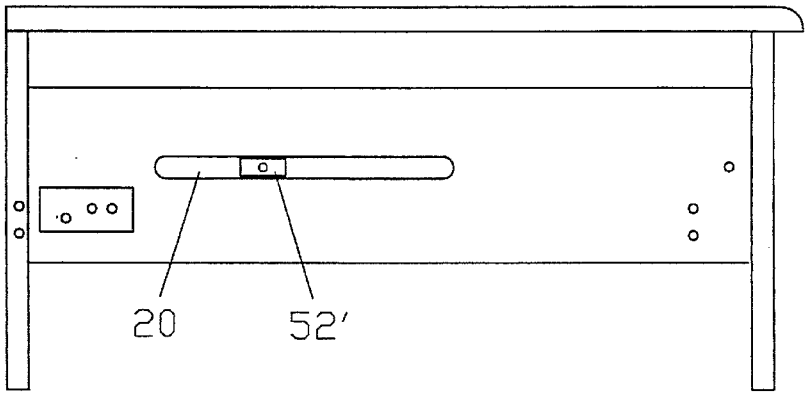
FIG. 13 is a section 13—13 of FIG. 1 which shows a slider itself as a movable bearing slot surface.

An alternative and preferred means for altering the kinematics of the movement of the seat and the back to reduce the forces needed to raise and lower the futon frame is to alter the shape of the base end slots which engage the back pivot pins. If the base end slots (16, 20) of the futon frame 10 of FIG. 1 are modified from substantially horizontal slots as illustrated in FIG. 13 to serpentine slots such as the base end slot 20' illustrated in FIG. 14, the kinematics of the opening and closing will be substantially changed. In addition to reducing the forces needed to open and close the futon frame, the new path is swept out by the supplemental support legs (72, 76) with 76 being shown in FIGS. 21 through 28. These slots are particularly advantageous for futons which are thick or tend to conform to the frame and adopt its shape.

It has been found that it is further preferred that the serpentine path have three segments, a rear segment, a middle segment, and a forward segment. The rear segment, which is about one fourth (¼) of the length of the traversed path, rises to a maximum height at the point where it meets the middle segment. The middle segment is about one half (½) of the total path length and falls off from the maximum height, to the lowest point on the path. The forward segment, which communicates with the middle segment, is the last one fourth (¼) of the length of the path and again rises.

It is further preferred that the maximum slope for the middle segment be less than about 15° which limits the force which needs to be applied to the seat in closing the futon frame 10'.

it is further preferred that the rise from the low point of the rear segment should be about one half (½) of the rise from the low point in the forward segment. Having a steeper grade for the forward segment of the path brings a second benefit in that the seat 32 will rise more rapidly carrying the supplemental support legs (72, 76) further backward and assuring that the supplemental support legs (72, 76) are behind the base forward cross member 68 as they are lowered.

Figure 14:
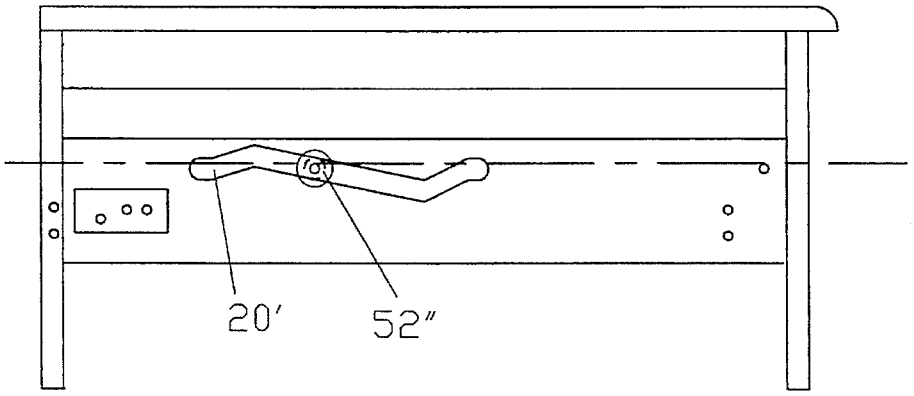
FIG. 14 is a section 13—13 of FIG. 1 for a modified embodiment wherein the substantially horizontal base end slots have been changed to serpentine slots and the sliders have been replaced by a rollers.

In order to illustrate the distinctions between the movement associated with opening a couch which employs substantially horizontal slots such as the base end slot 20 of FIG. 13 and a couch which employs serpentine slots such as the base end slot 20' shown in FIG. 14. A series of side views for each couch have been prepared and are included in FIGS. 15 through 26. FIGS. 15 through 20 show the futon frame relative positions between a closed position and an open position for a frame with a straight slot. FIGS. 21 through 26 illustrate the same relative positions for a couch where the base end slot is serpentine.

As can be seen by comparing the FIGS. 15 and 21 and FIGS. 20 and 26, the closed position of each of the frames is the same and the open position is the same; the distinction occurs at intermediate positions.

Figure 27:
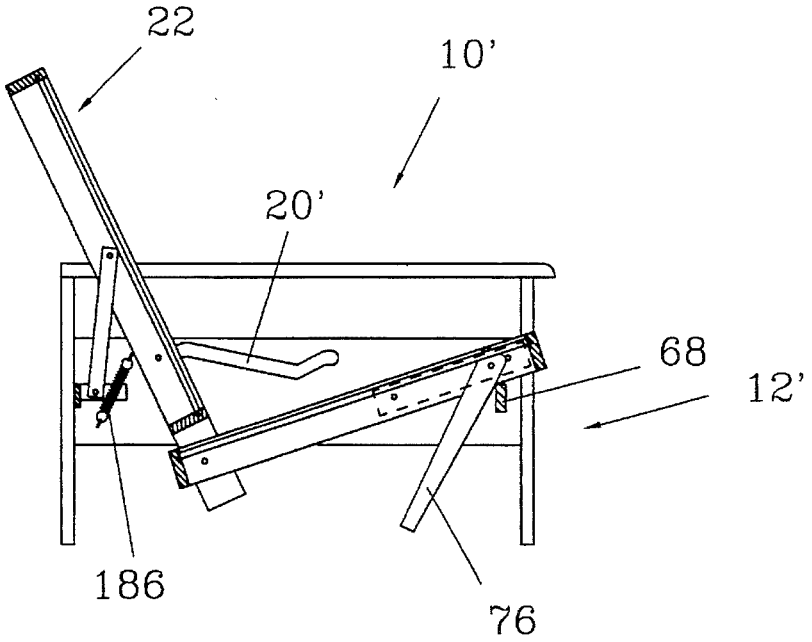
FIG. 27 is a cross section for a frame of the type illustrated in FIG. 1 with the serpentine slot of FIG. 14. This embodiment differs from the embodiment of FIG. 14 in that a spring has been supplied which attaches to the frame to provide assistance in the closing of the frame.
Figure 28:
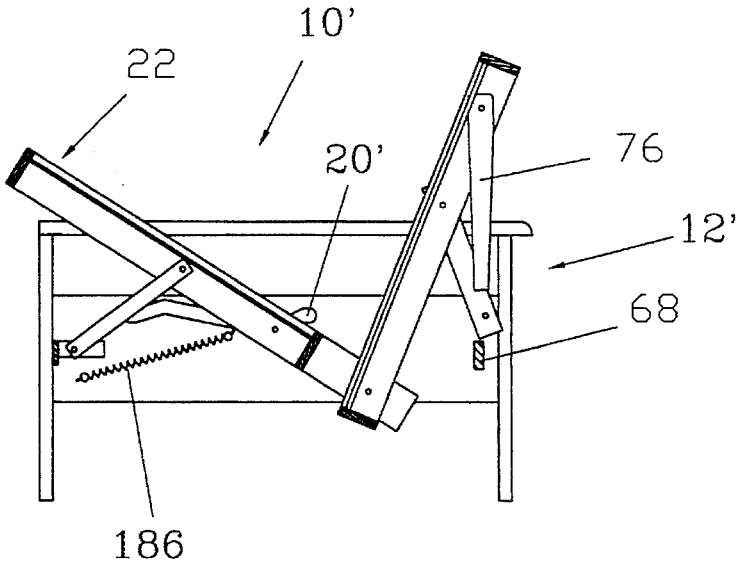
FIG. 28 illustrates the frame of FIG. 27 in the partially open position and illustrates the spring where the spring has been stretched, increasing the strain. In this position, the spring is assisting in closing the frame.

FIGS. 27 and 28 illustrate another embodiment of the present invention which employs a serpentine slot such as the base end slot 20' illustrated in FIGS. 27 and 28. This embodiment also provides springs which are attached to a base 12' and to the back 22.

As the couch opens, as illustrated in FIG. 28, the spring is elongated and will tend to return the futon frame 10' to a closed position. When the futon frame 10' is fully open, due to the locking character of the frame, it will remain open.

To more fully illustrate the benefit of the invention, the following examples are offered:

EXAMPLE 1

A frame was built in the configuration shown in FIG. 1. This frame was constructed with a substantially horizontal base end slot and maintains the separation of the axes as follows:

AB 10 inches

BC 8¼ inches

CD 8¼ inches

DE 15¾ inches

It was found that when the length CD was reduced to about one half (½) of BC, that the futon frame was much more difficult to raise when a heavy futon was employed and when the futon frame was on a hard surface, the futon tended to slide.

EXAMPLE 2

The futon frame of EXAMPLE 1 was modified by providing a serpentine base end slot where the length of the sections were:

Rear segment: 3 inches

Middle segment: 6 inches

Front segment: 3 inches

Rise in rear segment: 1 inches

Rise in front segment: 2 inches

Max. grade of middle segment: 15°

It was found that the use of the serpentine base end slot was effective in facilitating the raising and lowering of frames which had thick non-compliant futons placed thereon. It also worked well for futons which had a tendency to conform to the futon frame and adopt its shape when folded into a seat configuration.

Figure 16:
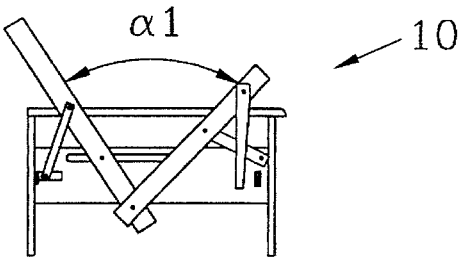
Figure 17:
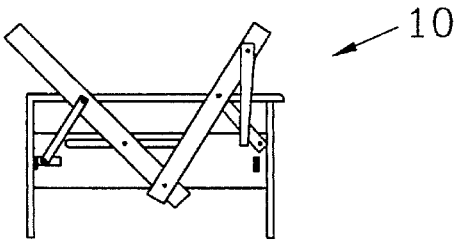
Figure 22:
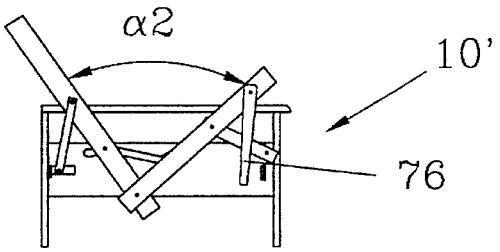
Figure 23:
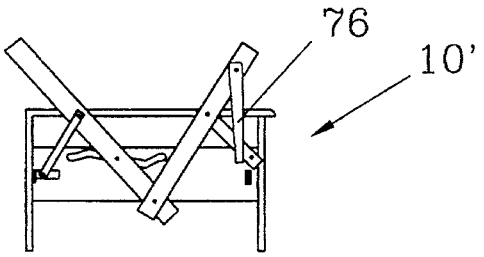

FIGS. 16 and 22 show the futon frames 10 and 10' in the early stage of opening. When opening the futon frame, the futon on the couch may, depending on its thickness and resilient character, tend to wedge in the corner generated at the intersection of the back and seat.

Comparing FIGS. 16 and 22, it can be seen that the angle $\alpha_1$ for the couch with the substantially horizontal base end slot 20 is less than the angle $\alpha_2$ for the couch with the serpentine base end slot 20'. Maintaining a more open angle $\alpha_2$ will result in the lessening of the compression of the futon frame during the early portion of the opening of the frame to form a bed. This is beneficial to the opening since the futon, after it has conformed to the seat by persons sitting thereon, will be wedged into the corner and resist further compression.

Figure 18:
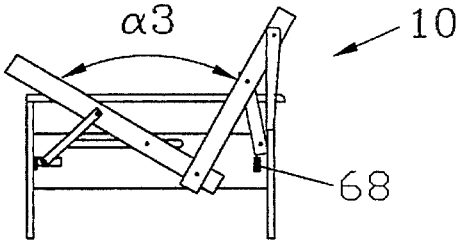
Figure 19:
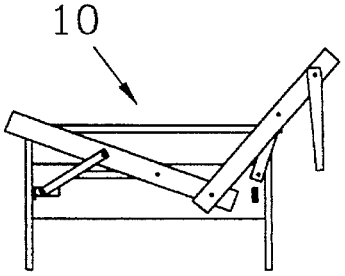
Figure 20:
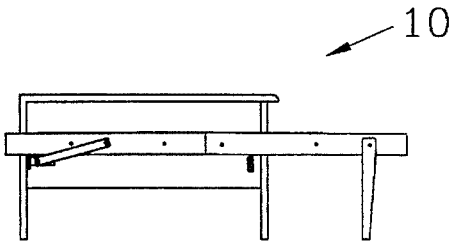
Figure 21:
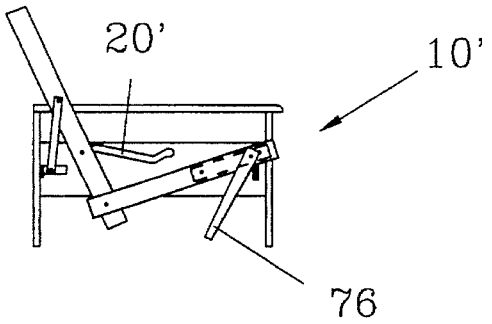
FIGS. 21 through 26 are side views at the same stage of opening as FIGS. 15 through 20 where the substantially horizontal base end slots have been changed to serpentine base end slots.
Figure 24:
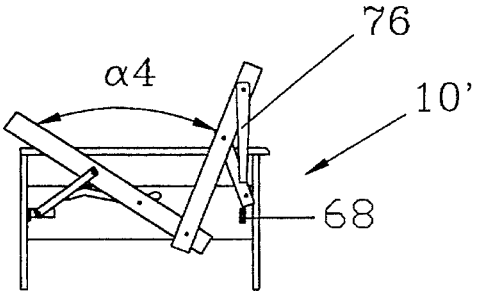
Figure 25:
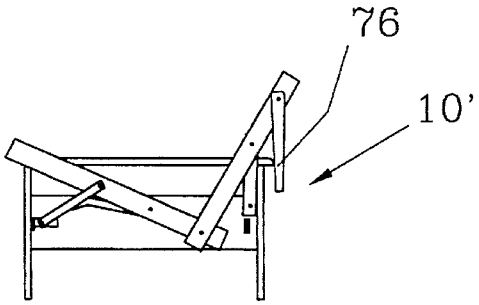
Figure 26:
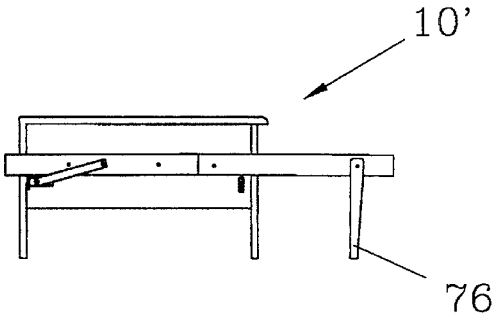

Also by comparison of FIGS. 18 and 24, one can see that while the angle $\alpha_4$ on the futon frame with the serpentine base end slot is less than $\alpha_3$ on the futon frame with the substantially horizontal base end slot, this is in the mid-portion of the opening cycle thus, the futon frame has greater freedom of movement. Furthermore, it can be seen that the legs have risen higher thereby assuring that the supplemental support legs (72, 76) will fall behind the base forward cross member 68 as the legs (72, 76) are lowered.

While the invention has been described in terms of preferred embodiment, it should be appreciated that variations of the present invention are possible in light of the above teaching and that variations can be made without departing from the spirit of the invention.

What I claim is;

1. A futon frame for supporting a futon forming a chair or sofa when the futon frame is in a closed position and forming a bed when the futon frame is in an open position, the futon frame comprising:

a base having a first end with a first base end slot and a second end with a second base end slot;

a back having a first back side member and a second back side member;

a first back pivot pin attaching to said first back side member and slidably engaging said first base end slot;

a second back pivot pin attaching to said second back side member and slidably engaging said second base end slot;

a first back support pivotably attaching to said first back side member and to said base;

a second back support pivotably attaching to said second back side member and to said base;

a seat having a first seat side member and a second seat side member, said seat pivotably attaching to said back;

a first seat support pivotably attaching to said first seat side member and to said base; and a second seat support pivotably attaching to said second seat side member and to said base.

2. The futon frame of claim 1 wherein said base further comprises:

a base forward cross member;

a first supplemental support leg pivotably attached to said seat;

a second supplemental support leg pivotably attached to said seat;

further wherein:

said first supplemental support leg has a first base forward cross member engaging surface; and said second supplemental support leg has a second base forward cross member engaging surface, said first supplemental support leg and said second supplemental support leg being pivotably mounted about points which are forward of said forward cross member when the futon frame is in the closed position.

3. The futon frame of claim 2 wherein;

said first back support and said second back support pivot about a first pivot axis A in the futon frame and about a second pivot axis B in said back;

said first back pivot pin and said second back pivot pin lie on a third axis C which is in said back;

said back and said seat pivot about a fourth axis D lying in said back and said seat; and said first seat support and said second seat support pivot about a fifth pivot axis E lying in said seat and a sixth pivot axis F in the futon frame; and further wherein:

said axes B, C, and D lie in a first plane and said axes D, E, and F lie in a second plane when the futon frame is closed, and when the futon frame is open, said first plane and said second plane are co-planar when the futon frame is in an extended position for sleeping.

4. The futon frame of claim 3 wherein the futon frame further comprises:

a base aft cross member: and base hinges attached to said base aft cross member which are pivotably connected to said first back support and said second back support.

5. The futon frame of claim 4 wherein the separation between said axes B and C is approximately equal to the separation of said axes C and D and the separation of said axes B and D is approximately equal to the separation of said axes D and E.

6. The futon frame of claim 5 further comprising:

a first roller interposed between said first base end slot and said first back pivot pin; and a second roller interposed between said second base end slot and said second back pivot pin.

7. The futon frame of claim 6 wherein said first base end slot and said second base end slot traverse a serpentine path over which said first roller and said second roller traverse.

8. The futon frame of claim 7 wherein said serpentine path further comprises:

a rear segment;

a middle segment; and a forward segment, wherein said rear segment is about one fourth (¼) of the length of said path, said middle segment is about one half (½) of the length of said path, and said forward segment is about one fourth (¼) of the length of said path.

9. The futon frame of claim 8 wherein said serpentine path is further configured such that said rear segment has a rise of about the rise of said front segment and said middle segment has a grade of less than about 15°.

10. The futon frame of claim 9 further comprising one or more springs attached to said base and to said back.

11. The futon frame of claim 4 further comprising:

a first slider interposed between said first base end slot and said first back pivot pin; and a second slider interposed between said second base end slot and said second back pivot pin.

12. The futon frame of claim 11 further comprising one or more springs attached to said base and to said back.

13. The futon frame of claim 3 wherein the futon frame further comprises:

a first spacer attached to said first end of said base of the futon frame and pivotably connected with said first back support; and a second spacer attached to said second end of said base of the futon frame and pivotably connected with said second back support.

14. The futon frame of claim 13 wherein the separation between said axes B and C is approximately equal to the separation of said axes C and D and the separation of said axes B and D is approximately equal to the separation of said axes D and E.

15. The futon frame of claim 14 further comprising:

a first roller interposed between said first base end slot and said first back pivot pin; and a second roller interposed between said second base end slot and said second back pivot pin.

16. The futon frame of claim 15 wherein said first base end slot and said second base end slot traverse a serpentine path over which said first roller and said second roller traverse.

17. The futon frame of claim 16 wherein said serpentine path further comprises:

a rear segment;

a middle segment; and a forward segment, wherein said rear segment is about one fourth (¼) of the length of said path, said middle segment is about one half (½) of the length of said path, and said forward segment is about one fourth (¼) of the length of said path.

18. The futon frame of claim 17 wherein said serpentine path is further configured such that said rear segment has a rise of about the rise of said front segment and said middle segment has a grade of less than about 15°.

19. The futon frame of claim 18 further comprising one or more springs attached to said base and to said back.

20. The futon frame of claim 13 further comprising:

a first slider interposed between said first base end slot and said first back pivot pin; and a second slider interposed between said second base end slot and said second back pivot pin.

21. The futon frame of claim 20 further comprising one or more springs attached to said base and to said back.

* * * * *